United States Patent [19]

Villanueva

[11] 4,374,518

[45] Feb. 22, 1983

[54] ELECTRONIC DEVICE FOR PNEUMOMASSAGE TO REDUCE LYMPHEDEMA

[76] Inventor: Raul Villanueva, 4102 Mischire, Houston, Tex. 77035

[21] Appl. No.: 195,515

[22] Filed: Oct. 9, 1980

[51] Int. Cl.[3] ..... A61H 7/00

[52] U.S. Cl. ..... 128/64

[58] Field of Search ..... 128/24 R, 24.1, 134, 128/133, 60, DIG. 20, 25 B; 2/22

[56] References Cited

U.S. PATENT DOCUMENTS

| | | | |
|---|---|---|---|
| 2,168,611 | 8/1939 | Thompson | 128/38 |
| 2,225,308 | 12/1940 | Kroll | 128/24 R |
| 2,528,842 | 11/1950 | Poor | 128/DIG. 20 |
| 2,531,074 | 11/1950 | Miller | 128/DIG. 20 |
| 2,533,504 | 12/1950 | Poer | 128/60 R |
| 2,781,041 | 2/1957 | Weinberg | 128/24 R |
| 2,832,336 | 4/1958 | Davis et al. | 128/DIG. 20 |
| 3,177,866 | 4/1965 | Wesslund | 128/24 R |
| 3,269,036 | 8/1966 | Parker et al. | 2/22 |
| 3,391,692 | 7/1968 | Spielberg | 128/24 R |

*Primary Examiner*—Richard C. Pinkham
*Assistant Examiner*—T. Brown
*Attorney, Agent, or Firm*—Ranseler O. Wyatt

[57] ABSTRACT

The invention relates to a device for pneumomassage of a limb of a patient. The device is provided with an outer boot having a series of compartments which conform to the contour of a human foot and leg, the foot part of the boot having a rigid sole, and an inner boot having a single compartment. A compressor is provided for successively inflating and deflating the inner and outer boots in a rythmic, preselected cycle. A timer is provided for maintaining the pressure in the boots for an indefinite period of time and for raising the pressure at any time during the cycle.

3 Claims, 6 Drawing Figures

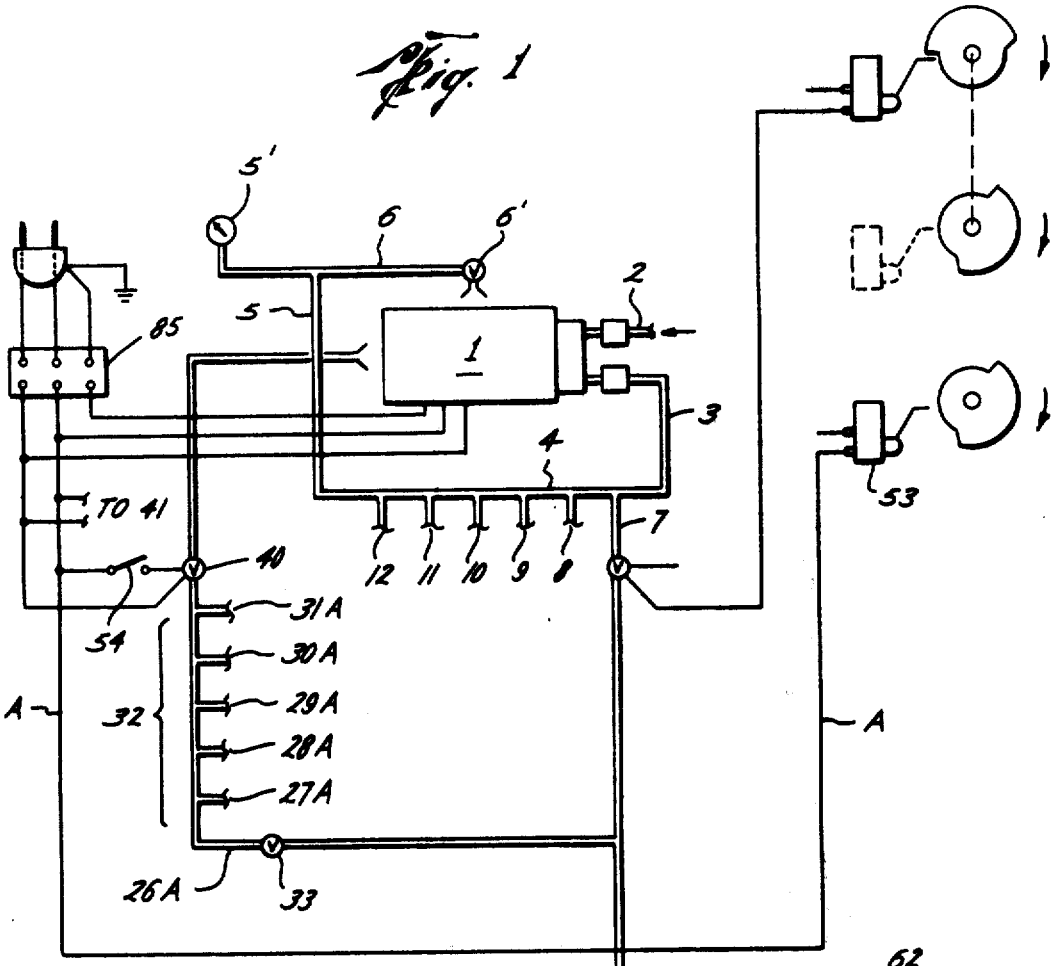
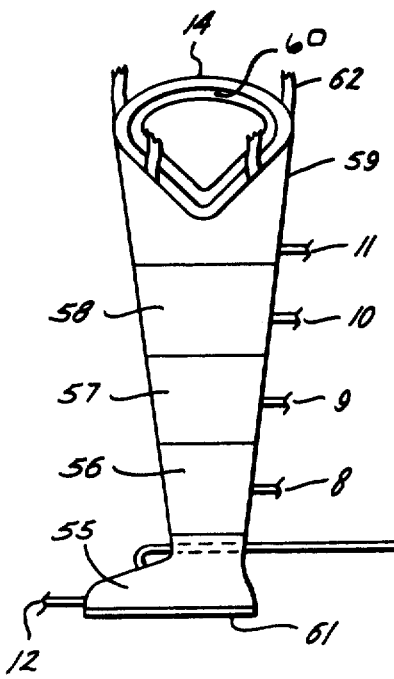
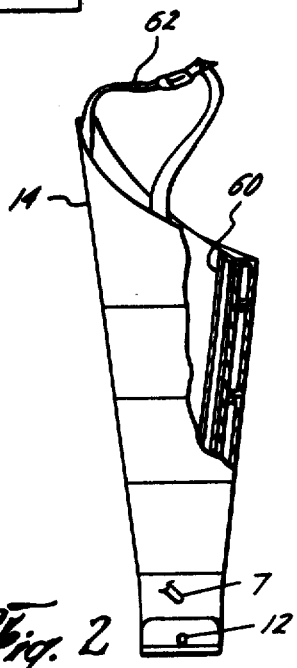
Fig. 2

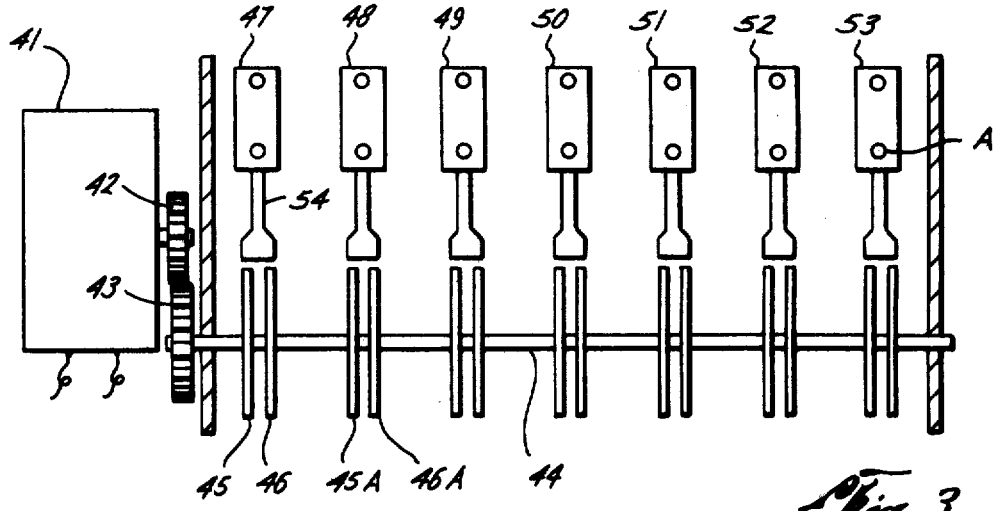
Fig. 3
Fig. 4
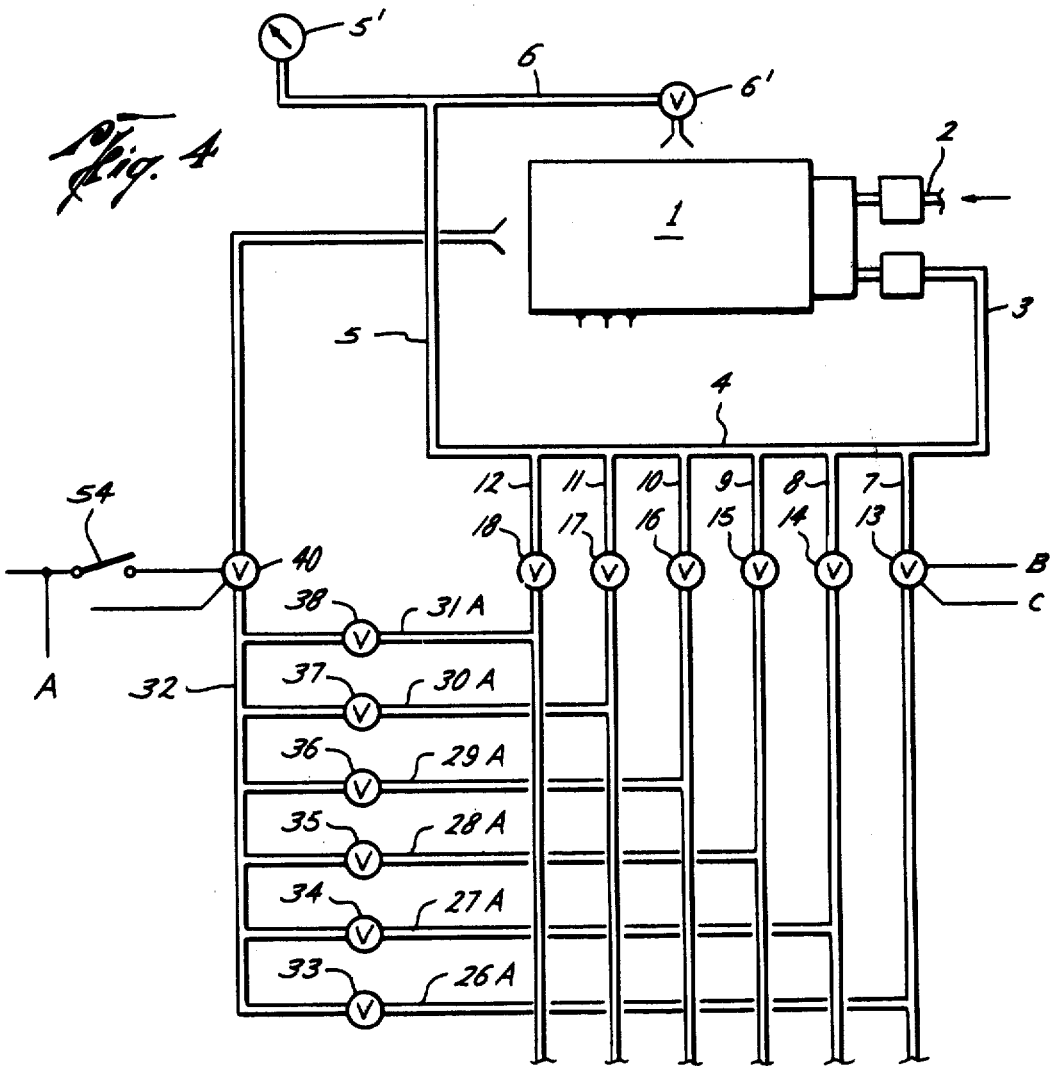

ELECTRONIC DEVICE FOR PNEUMOMASSAGE TO REDUCE LYMPHEDEMA

BACKGROUND OF THE INVENTION

Lymphedema of the extremities is a disease that could be primary, such as congenital lymphedema, or secondary, such as following radical lymphnode disection of the axilla and/or groin as in treatment for cancer.

Secondary lymphedema presents itself in many variables and one of the forms of treatment is an outside compression in order to help remove from the limb the extra lymph fluid that may accumulate every day in the subcutaneous tissue.

Conservative treatment is utilized in the form of pneumatic massage, Ace bandages wrapping, arm elevation, etc. The apparatus here described is one that will produce a true gradient, from distal to proxymal pressure on the affected limb, that will help in reducing the amount of lymphedema, or edema, present in the subcutaneous tissue.

When the patient has a combination of lymphedema and edema, otherwise known as low concentration lymphedema, due to vascular obstruction, the problem is more complex and requires sustained pressure on the limb, for long periods, (thirty minutes to an hour) for better results. While Ace bandage wrapping provides this sustained pressure, it has the disadvantage of not being possible for self treatment, by the patient, and not having readily available a trained technician to do it for the patient as well as the fact that it results in uneven pressure and therefore does not produce very good results.

This apparatus substitutes the mechanical portion of the circulator for a series of electronically controlled valves, to produce the inflation of the respective compartment of the boot and to provide means for relief of this pressure or maintaining the pressure as desired. One prior art device employs a cylindrical sleeve, rather than a boot. The boot of the Applicant's invention will have a rigid sole with pressure applicable only over the dorsum of the foot, avoiding the above mentioned problems.

The prior art device is considered an open compression circuit, as long as the compressor is working as in its normal cycle, the pressure within the apparatus and the inflating will remain as selected, but it has no means to maintain the preselected pressure for any length of time, when this is required, as it occurs in many patients where the pressure must be maintained for thirty minutes to one hour; if the compressor was to be turned off at the end of the inflating cycle and before the deflating time, the pressure within the inflating device will be lost within the first one or two minutes, through the rotating cylinder.

When the above mentioned metallic rotating device is changed for an electronically controlled set of solonoid valves, the mechanical problem of rust, the uneven inflation and the lack of safety of use by the patient alone, are eliminated, adding separate manifolds that will maintain the air flow completely separate of the different compartments of the boots, and when one of said manifolds will contain a one way check valve and an electronically controlled solonoid valve for the release of pressure, the device will become a closed compression circuit and the pressure will be maintained for a longer time, or as long as desired, by not activating the release valve mentioned, or when the patient desires, will by choice through the use of a safety switch, selectively activate the release valve and release the compression, anywhere during the cycle.

The unnecessary pressures and strains placed on the foot and ankle are totally eliminated when a boot is utilized that provides the same shape of the leg and foot and a stiff sole is placed in the foot end, to produce support so that pressure is applied only to the dorsum of the foot and not a squeeze. The addition of a hip portion and means to hold it up at the waistline prevents the rolling down of the cylindrical sleeve that occurs on the cyclic inflation and deflation. This rolling down that occurs with the sleeve of the prior art device results in the formation of an unsupported roll where the lymphedema will accumulate, below the groin.

Additional safety features are: the addition of indicating lights that turn on and off with each individual line of inflation, to alert the patient of any fault in the mechanism of inflation. The selective device that the user has at hand to activate a relief valve for emptying inflated compartments, anytime during the cycle, so that if for any reason the user must get out of the boot, this may be accomplished without need of assistance.

All of these features make this new device useable by a person at home, without supervision, eliminating the need for hospitalization or travel to a clinic away from home.

The reasons that an inner boot of a single compartment is needed are two: First, since all of the materials utilized are thermal sealed plastics or rubber, they make a seam over which pressure is not applied, resulting in skin lymphatics taking pressure from above and below, to their damage. The inner boot will accomplish a smoothing of these areas eliminating the problem. An inflating device that consists of one single compartment has the physiological disadvantage to a user in that it produces equal pressure above, in the middle and at the lower end, all at the same time, contrary to the device with multiple compartments that produces a gradient pressure from distal to proxymal, assisting the normal flow of fluid and protecting the valves within the vessels themselves.

SUMMARY OF THE INVENTION

A device for pneumomassage to reduce lymphedema having an inner and an outer boot adapted to envelope the leg and foot of a user, the inner boot having a single compartment and a series of compartments in said outer boot to be successively and progressively inflated and simultaneously deflated, having manifolds under a constant air pressure and conduits leading from one of the said manifolds to the respective compartments of the boots which may be inflated and deflated by means of the timer controlled valves, to provide a rythmatic application of pressure from the foot to the hip of the patient, the outer boot having a stiff sole to permit massage over the upper area of the foot without undue pressure on the toes or joints, and straps on the upper end of the outer boot to secure the boot in place and said device being provided with a manifold with one way valves to obtain discharge of the air in the boots over the compressor for cooling same. The inlet manifold and the discharge manifold, above referred to, are maintained under equal pressure to hold the pressure applied to the respective compartments, and a relief valve for discharging the air at the termination of each ckcle, and which may also be selectively actuated through the manually operated safety switch at any point in the cycle by the patient.

BRIEF DESCRIPTION OF THE DRAWINGS

FIG. 1 is a diagrammatic illustration of the device.

FIG. 2 is a front elevational view of the boot employed, partially in cross section.

FIG. 3 is a diagrammatic view of the electric switch control system.

FIG. 4 is an enlarged, diagrammatic view of the air flow system, and

DESCRIPTION OF THE PREFERRED EMBODIMENT

Figure 5:
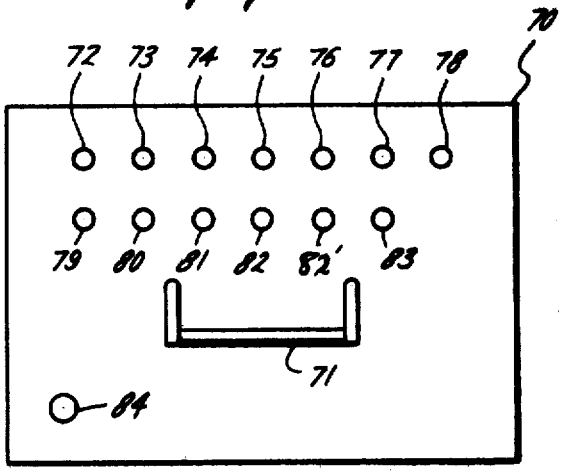
FIG. 5 is a front elevational view of the housing.
Figure 6:
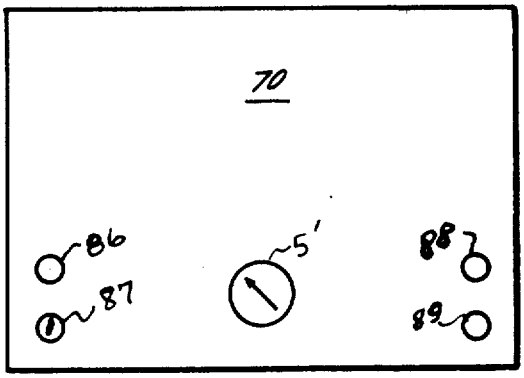
FIG. 6 is a rear elevational view thereof.

In the drawings, the numeral 1 designates an air compressor, having an air intake line 2 and an air discharge line 3 which feeds the inflation manifold 4. The line 5 leads out of the manifold 4 to a gauge, such as a manometer 5', and a connecting line 6 extends laterally from said gauge and in which is mounted the pressure control valve 6' for maintaining the desired pressure within the entire device. Upon opening the first valve in a conduit leading from the manifold 4, a pre selected pressure will be built up in the respective compartments of the inner and outer boot and the manifold 57, which will be maintained for any length of time desired by the one way valves hereinafter described.

Pressure lines 7, 8, 9, 10, 11, 12 lead from the manifold 4, and solonoid valves, normally closed, designated as 13, 14, 15, 16, 17, 18 respectively, are mounted in the said conduits leading from said manifold 4, and each of said conduits leading from each of the said solonoid valves 13 to 18 terminate in one of the compartments in the boot 14, and the inner boot 60, the line 7 terminating in compartment 55; the line 8 terminating in compartment 56, the line 9 terminating in the compartment 57, and the line 10 terminating in the compartment 58 and the line 11 terminating in the compartment 59, and line 12 extending through the compartment 55, terminating in the inner boot 60. Each boot is provided with a foot compartment which extends in a natural way from the leg portion of the boot corresponding to the normal human leg and foot contour, and the outer boot has a stiff sole, as 61.

Each of the lines 7 to 12, both inclusive, has a discharge line in flow connection with said lines 7 to 12, respectively, and which are connected into the discharge manifold 32, the said discharge lines being 26A, which connects into line 7; 27A which connects into line 8. 28A which connects into line 9; 29A which connects into line 10; 30A which connects into line 11, and 31A which connects into line 12. A one way check valve is connected at the end of each of said discharge lines, the check valve for line 26A being designated as 33; the one in line 27A as 34; and the one in line 28A as 35; an the one in line 29A as 36; and the one in line 30A as 37; and the one into line 31A as 38. These check valves maintain the pressure in the compartments of the outer boot and inner boot until the cycle is completed, or may be maintained as long as desired.

A relief valve 40 may be actuated by the electronically controlled timer during the pre-selected cycle, as well as by a manually operated safety switch 54 to provide relief of the pressure on the system at the end of each cycle or by means of the safety switch 54 at any time by the user during a treatment.

The respective solonoid valves in the conduits leading from the manifold 4 are controlled electronically, having a timer which is set to rotate at 0.5 RPM. Mounted on the shaft 44 are the switch operating cams and switches, as used in the Industrial Adjustable Cam Programmer with multiple precision switches. The cam programmer can be substituted by an electric board with transistorial circuits to accomplish the same electronic control, adding the range of use to direct current in addition to alternating current.

The respective valves in the conduits leading from the manifold 4 have a timer 41, which is preferably set to rotate the gears 42, 43 and shaft 44. Mounted on the shaft 44 are the switch operating cams 45,46 and switches 47, through 53, both inclusive, as are well known in the art. The first cam 45 will raise the switch arm 54 and open the circuit through the switch 47 and lines B and C, causing the solonoid valve 13 to open, permitting an air flow through the conduit 7 to the compartment 55, inflating that compartment to the pressure preselected, the gap in the timer on each disc being adjustable to permit the desired volume of air flow, and the second cam 46 closes the circuit and the air stops flowing through line 26, a similar action follows through the next set of cams 45A, 46A, to open and close the next solonoid valve, until switch 52 has been open and closed so that the first, second, third, fourth and fifth compartments of the outer boot and the single compartment of the inner boot have been inflated, the time during which each solonoid valve is open is fifteen seconds; when all are inflated, there is a period of ten seconds during which all will maintain the preselected pressure, before the switch 53 is opened, at which time the discharge valve 40 is activated and opens, permitting all the air in the inner and outer boots to be discharged through the manifold 32, for a period of twenty seconds, which completes the cycle, and a new cycle will begin. If medically indicated, the switch 53 can be turned off during the above mentioned ten seconds, and the pressure maintained in all compartments before the discharge solonoid valve 40 is opened, so that the preselected pressure will be maintained for as long as ordered, since this device is a closed compression circuit during the mentioned time.

Straps forming a body harness, as 62, permit securing the top of the boot to the body of the user, preventing the movement longitudinally of the boot during the inflation and deflation process.

The control mechanism employed assures the steady massage of the limb toward the trunk, and the complete smoot inflation of the inner boot covers any territory passed over by the seams of the compartments, and the straps anchored tightly about the body of the patient prevent longitudinal movement, and rolling of the top of the boots as the inflation is accomplished, then released. Elimination of the metallic cylinder rotating controller makes the device ready at all times to use without danger of rust or corrosion blocking the movement of any of the parts. The compartments of the respective boots permits comfortable massage of the entire limb. The unit, of course, may be modified, as desired, so that it may be used on an arm as well, and the industrial electronic programmer may be substituted by a transistorized system to accomplish the same two minute cycle, release of the pressure at will and ability to use it on direct current or alternating current.

The device may be housed in a container so that it will be portable and readily used in an ambulance or in the home of a patient. The housing 70 may form a carrying case having a handle as 71 and having lights 72 through 77 which are ignited when the respective valves are actuated. The plug 84 connects to the source of power, and leads in to the plate 85, and the circuit is through the timer 41, switches 47 to 53, respectively, to the solonoids controlling the solonoid controlled valves. Similar light 86 ignites when the switch 87 is in "on" position, being connected into the line from the source of power, and the light 88 connects into the solonoid controlling the solonoid controlled valve 40 and will indicate to the user when that switch is in on position. The device being designed to be used by a patient in his home, or by medical attendants in an ambulance, it is essential that they have means for readily ascertaining what the unit is doing. The safety switch permits immediate deactivation of the unit and release of all pressures being applied so that the boots may be removed quickly and easily.

A fuse light 88 may be provided, if it is desired to employ a fuse in the electrical circuit, and a light to indicate that the pressure control valve 6' is operating may be included, as 89.

What I claim is:

1. A device for pneumomassage of the limb of a patient, an outer boot having a series of compartments, the most distal of which conforms to the contours of a human foot with a rigid sole, an inner boot having a single compartment, both of said boots extending up to the hip girdle, means for anchoring the outer boot tightly about the body of the user to prevent longitudinal movement and rolling of the top of the boots, means for successively inflating and simultaneously deflating said compartments of the inner and outer boots in a rythmic, preselected cycle, means for maintaining the pressure for an indefinite period of time and for selectively releasing the pressure at any time during the cycle, said means for inflating said compartments of the boot comprises an air compressor with a thermally protected motor, a first manifold supplied with air from said compressor and maintained at a preselected pressure, electronically controlled solonoid valves, conduits leading from said manifold and terminating in said valves, a discharge manifold, and a second manifold of inflating conduits, conduits leading from said discharge manifold, check valves in said conduits, said conduits extending from said check valves and connected into the inflating conduits forming the second manifold, said solonoid valves in said inflating conduits adapted to allow the air to flow from the compressor to the boot compartments and said check valves adapted to maintain equal pressure within said conduits and manifolds, said check valves adapted to maintain the pressure within each individual compartment, a solonoid check valve in said discharge manifold and means for opening said solonoid valve leading from the discharge manifold and relieving the pressure within the boot.

2. A device for pneumomassage of the limb of a patient, an outer boot having a series of compartments, the most distal of which conforms to the contours of a human foot with a rigid sole, an inner boot having a single compartment, both of said boots extending up to the hip girdle, means for anchoring the outer boot tightly about the body of the user to prevent longitudinal movement and rolling of the top of the boots, means for successively inflating and simultaneously deflating said compartments of the inner and outer boots in a rythmic preselected cycle, means for maintaining the pressure for an indefinite period of time and for selectively releasing the pressure at any time during the cycle, said inflating means having an air compressor, and inlet manifold, an inlet conduit extending into said manifold from said compressor, a pressure gauge and a pressure control valve in said conduit, conduits leading from said manifold, two-way electronically controlled solonoid valves in said conduits, conduits extending from said solonoid valves to a second manifold formed by the intersection of discharge conduits, said discharge conduits extending from said intersection to a discharge manifold, and the first mentioned conduits forming said manifold extending one directly to the corresponding compartment of the boot and the other to connect with the discharge manifold, a one way check valve in each of said conduits leading into said discharge manifold, said connecting means between the solonoid valves, the discharge manifold and the boot compartments maintaining the same pressure of the inlet manifold, means to release the pressure from within the said connecting means by activating electrically a solonoid valve connected to the discharge manifold at the end of each cycle, a safety switch for selectively releasing the pressure from the compartments at any time during the cycle, by selectively activating the discharge solonoid valve when the patient using the safety switch will avoid the remaining sequential portion of the cycle, and maintaining the pressure within the boot compartments for as long as desired.

3. A device for pneumomassage of the limb of a patient, an outer boot having a series of compartments, the most distal of which conforms to the contours of a human foot with a rigid sole, an inner boot having a single compartment, both of said boots extending up to the hip girdle, means for anchoring the outer body boot tightly about the body of the user to prevent longitudinal movement and rolling of the top of the boots, means for successively inflating and simultaneously deflating said compartments of the inner and outer boots in a rythmic preselected cycle, means for maintaining the pressure for an indefinite period of time and for selectively releasing the pressure at any time during the cycle, said inflating and deflating means have an air compressor, an inlet manifold, a conduit for supplying air to said manifold, a pressure gauge and a pressure control valve in the said conduit to said manifold, and electronically controlled solonoid valves, with conduits from said manifold to the electrically controlled solonoid valves and conduits from said solonoid valves forming a second manifold from which two conduits are supplied with air, one leading to the respective compartments of the outer and the inner boot and the other one to the discharge manifold through a one way check valve in said discharge manifold, a connecting conduit from said discharge manifold to an electrically controlled solonoid valve for the release of pressure in the boot compartments, an electric circuit comprising a source of power, a power supply line extending from said source of power to an electronic cam programmer with a timer and switches, and switch arms and cams mounted on a rotating shaft in position to actuate said switches, with said cams allowing each switch arm to descend and contact a switch and to raise said switch arm closing the circuit and deactivating the said solonoid closing the said valve, all of these to occur in a predetermined time of the cycle, permitting the air to flow and inflate the respective boot compartments and to maintain the pressure therein until the discharge solonoid valve is activated, at the end of the cycle, allowing the air to escape through the discharge manifold and release the pressure, this same effect is obtained when the patient selectively at any time during the cycle, activates the discharge solonoid valve to release the pressure or turns the apparatus off and maintains the pressure within for a desired time.

* * * * *